US005351852A

United States Patent [19]

Trageser et al.

[11] Patent Number: 5,351,852

[45] Date of Patent: Oct. 4, 1994

[54] BASE PROFILE FOR A DRAWN CONTAINER

[75] Inventors: Andrew B. Trageser, Cheswick; Gary L. Myers, Natrona Heights; Hans H. Diekhoff, Avonmore, all of Pa.

[73] Assignee: Aluminum Company of America, Pittsburgh, Pa.

[21] Appl. No.: 773,773

[22] Filed: Oct. 10, 1991

Related U.S. Application Data

[63] Continuation of Ser. No. 583,423, Sep. 17, 1990, abandoned.

[51] Int. Cl.[5] ..... B65D 17/00

[52] U.S. Cl. ..... 220/606; 220/906

[58] Field of Search ..... 220/606, 608, 609, 906

[56] References Cited

U.S. PATENT DOCUMENTS

| | | | |
|---|---|---|---|
| 3,760,751 | 9/1973 | Dunn et al. | 113/120 H |
| 3,905,507 | 9/1975 | Lyu | 220/66 |
| 3,912,109 | 10/1975 | Essex, Jr. et al. | 220/606 X |
| 3,942,673 | 3/1976 | Lyu et al. | 220/606 X |
| 4,147,271 | 4/1979 | Yamaguchi | 220/70 |
| 4,151,927 | 5/1979 | Cvacho et al. | 220/70 |
| 4,222,494 | 9/1980 | Lee, Jr. et al. | 220/66 |
| 4,515,284 | 5/1985 | Lee, Jr. et al. | 220/70 |
| 4,578,007 | 3/1986 | Diekhoff | 413/6 |
| 4,646,930 | 3/1987 | Karas et al. | 220/70 |
| 4,685,322 | 8/1987 | Clowes | 72/348 |
| 4,685,582 | 8/1987 | Pulciani et al. | 220/66 |
| 4,768,672 | 9/1988 | Pulciani et al. | 220/606 |
| 4,834,256 | 5/1989 | McMillin | 220/606 |
| 4,836,398 | 6/1989 | Leftault, Jr. et al. | 220/609 |
| 4,919,294 | 4/1990 | Kawamoto et al. | 220/606 |
| 4,938,374 | 7/1990 | Wuchterl | 220/906 X |

*Primary Examiner*—Steven M. Pollard
*Attorney, Agent, or Firm*—William J. O'Rourke, Jr.; Gary P. Topolosky

[57] ABSTRACT

A drawn container is disclosed having a substantially cylindrical sidewall extending upwardly from an integral base portion to form an open neck which is double seamed with a top end closure. The base portion has a downwardly extending, generally U-shaped, circumferential nose portion, the outside surface of which defines the plane of the base of the container on which the container normally sets. The nose portion is defined by a radius between a substantially vertical inner wall and an outside wall. The outside wall extends from a lower portion of the sidewall through a convex lower body radius to a concave profile radius disposed above the nose portion. A frustoconical portion is provided between the convex lower body radius and the concave profile radius. The frustoconical portion forms a lower body angle of at least 30° with respect to the plane of the base of the container. An inwardly directed bottom dome extends inwardly of the inner wall and has at least three progressively increasing radii of curvature in the direction of the center of the dome. A method is also disclosed for reforming the base portion of the above-described container. This method includes the steps of holding the substantially vertical disposition and the diameter of the inner wall defining the nose portion while simultaneously moving a reforming tool against the outside wall of the nose portion to tighten the nose radius therebetween and form the concave profile radius of the base portion while retaining a lower body angle greater than 30°, and retaining the progressively increasing radii of curvature in the bottom dome.

16 Claims, 3 Drawing Sheets

BASE PROFILE FOR A DRAWN CONTAINER

This application is a continuation of application Ser. No. 07/583,423, filed Sep. 17, 1990, now abandoned.

1. Field of the Invention

This invention pertains to drawn containers, and more particularly to an improved profile for the base of a drawn container and a method for forming or reforming such base.

2. Description of the Art

The process of drawing and ironing a sheet metal blank to make a thin-walled container body is well known. Such container bodies are typically double seamed to a can end to form a two-piece rigid package which typically holds a carbonated beverage, For the past twenty years or so, the metal manufacturers, can makers, end makers and carbonated beverage packers have been involved in a continuing drive to reduce the weight of the package, particularly the two-piece aluminum can. This lightweighting effort is generally focused on three different areas: (1) use of higher strength metal alloy compositions, (2) working of the metal to improve strength, and (3) refinement of the structure or shape of the can, particularly the can end and the can bottom, to increase strength.

It has been found that the starting gauge of the metal, from which a container body is drawn, is able to be reduced provided that the resulting package is able to withstand internal can pressures in excess of about 90 pounds per square inch without buckling. Also, the resulting package must not collapse when subjected to an axial load, typically on the order of 250 pounds or more, or when subjected to drop impact tests.

The shape, structure or profile of the base portions of a drawn container body affects the strength of the package, including its buckle pressure resistance, axial load capability and drop impact resistance. Therefore, considerable effort has been devoted to developing improved profiles for the integral bottom wall of a drawn container body and improved methods for forming and reforming such base portions. For example, U.S. Pat. No. 4,685,322 shows a method of providing an annular bead in the end wall of a drawn cup to prevent wrinkling in the end wall when it is subsequently redrawn. Also, U.S. Pat. No. 3,760,751 discloses a reforming operation for the bottom end wall in which an upwardly domed central portion is connected to the sidewall of the can through a vertical wall and an outwardly tapered shoulder.

Other exemplary patents directed to bottom wall structures for drawn and ironed can bodies include U.S. Pat. Nos. 3,905,507; 3,942,673; 4,147,271; 4,151,927; 4,222,494; 4,515,284; 4,646,930; 4,685,582; and 4,768,672.

Despite the prior art teachings in the area of base profiles for drawn container bodies, there is still a need and a desire for further improvement to allow lightweighting to continue. In particular, there is a need for an improved base profile, accomplished in base profile forming or in base profile reforming operations, to provide a package which resists buckle pressures and axial load to the point that further reductions in the gauge of the starting metal may be attained.

SUMMARY OF THE INVENTION

This invention may be summarized as providing a drawn container, with a reformed base portion, having a substantially cylindrical sidewall extending upwardly from an integral base portion to form an open neck which is double seamed with a top end closure. The base portion, of a gauge less than about 0.0116 inch, has a downwardly extending, generally U-shaped, circumferential nose portion, the outside surface of which defines the plane of the base of the container on which the container normally sets. The nose portion is defined by a radius between a substantially vertical inner wall and an outside wall. The radius of curvature of the nose portion is tightened in a reforming operation, The outside wall extends from a lower portion of the sidewall through a convex lower body radius to a concave profile radius disposed above the nose portion, A first frustoconical portion is provided between the convex lower body radius and the concave profile radius, The first frustoconical portion forms a lower body angle of at least 30° with respect to the plane of the base of the container, A second frustoconical wall portion is provided between the concave profile radius and the concave outside nose radius, The second frustoconical wall portion is disposed at an angle of from about 60° to about 90° with respect to the plane of the base of the container. An inwardly directed bottom dome extends inwardly of the inner wall and has at least three progressively increasing radii of curvature in the direction of the center of the dome.

The present invention also includes a method of reforming the base portion of the above-described container by holding the substantially vertical disposition and the diameter of the inner wall defining the nose portion while simultaneously moving a reforming tool against the outside wall of the nose portion to tighten the nose radius therebetween and form the concave profile radius of the base portion while retaining a lower body angle of a first frustoconical portion of greater than 30°, and while assuring that a second frustoconical wall portion, between the profile radius and the nose portion, is disposed at an angle of from about 60° to about 90° with respect to the base of the container.

Among the advantages of this invention is the provision of a base profile which provides can strength sufficient to allow further reduction of the starting gauge of the metal from which can bodies are drawn.

An objective of this invention is to provide an improved base profile for a drawn container which exhibits improved axial column load and increased buckle pressure, preferably when the nose of the base is reformed to tighten the radius of curvature thereof.

Another objective of this invention is to reduce permanent growth of the base of a drawn container such as may occur during pasteurization.

The base profile of this invention is particularly adapted to be reformed to provide a reformed base profile, having two frustoconical portions, exhibiting improved strength characteristics over prior art reformed base profiles.

Another objective of this invention is to provide a base profile which is not only strong, but also retains its stackability with conventional end shells.

These and other objectives and advantages of the invention will be more thoroughly understood and appreciated with reference to the following description and the accompanying drawings.

DETAILED DESCRIPTION

The present invention is preferably directed to drawn beer and beverage containers which hold relatively high internal pressures, but is also applicable to food cans and other rigid packages of various diameter and height having a generally cylindrical configuration. The term drawn is intended to include drawn as well as drawn and ironed.

Where the words "upwardly", "inward", "outwardly", "downwardly" and the like are used herein, the meaning, unless specifically indicated to the contrary, is to be applied with reference to a metal can standing on its base in an upright position.

The preferred container of this invention is an aluminum container, although steel and other materials are encompassed by this invention. The term aluminum is intended to encompass aluminum and aluminum alloys in coated and uncoated condition, including, but not limited to, metal dominant polymer aluminum laminates. Such coatings include protective and decorative coatings which may be applied on the inside or outside of the container before, during or after formation of the container.

Figure 1:
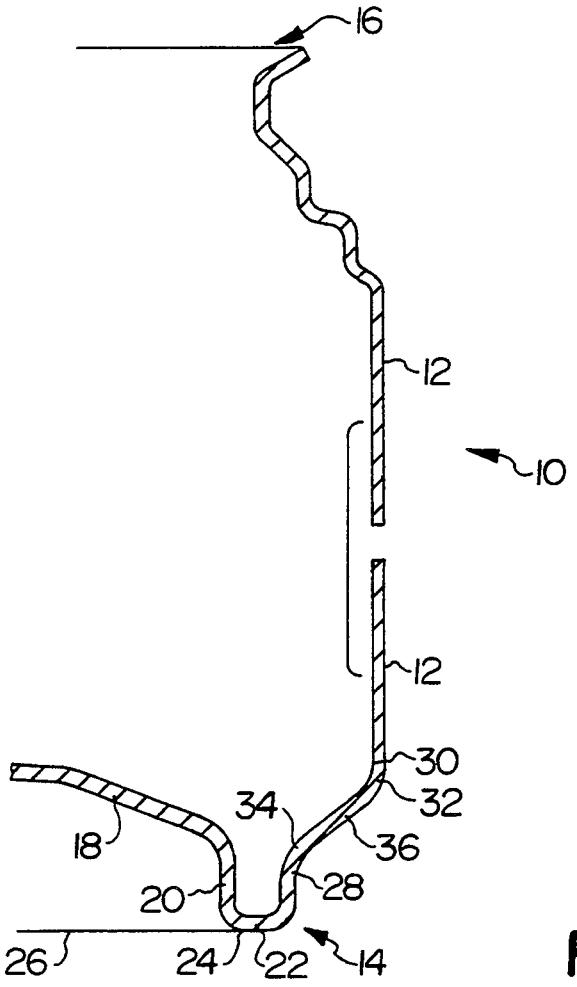
FIG. 1 is a cross-sectional view of a drawn container of the present invention.

Referring particularly to the drawings, FIG. 1 shows a typical drawn container 10. The container 10 has generally cylindrical sidewalls 12 extending upwardly from an integral base portion 14. The sidewalls extend upwardly to form an open neck 16. As is understood by those skilled in the art, the open neck 16 is adapted to be double seamed with a generally circular top end closure, one example of which is shown and described in U.S. Pat. No. 4,578,007, the contents of which are incorporated herein by reference.

The container 10 illustrated in FIG. 1 further includes a bottom dome 18. The bottom dome 18 extends upwardly and inwardly into the container bottom. A substantially vertical, i.e., ±4° from vertical, inner wall 20 defines an inside portion of a nose portion 22 of the container 10. The nose portion 22 extends outwardly and downwardly of the container and the outside surface 24 defines the plane 26 of the base of the container 10. The container 10 typically sits on this surface 24 defining the planar base 26.

The nose portion 22 has a radiused portion 22 defined between the inner wall 20 and an outside wall 28. This radiused portion 22 sometimes has one radius of curvature for the outside of the nose and a second, slightly different radius of curvature for the inside of the nose. The outside wall 28 extends from a base portion 30 of the sidewall 12 of the container 10, through a convex lower body radius 32, to a concave profile radius 34. Between the convex lower body radius 32 and the concave profile radius 34 is a first frustoconical portion 36.

A typical material used in forming a drawn container 10 such as that illustrated in FIG. 1 is aluminum alloy 3004 in H19 temper. The starting gauge of such material is typically on the order of 0.0116 inch, and there is a drive throughout the industry to lower this gauge. Reduction in gauge alone makes the can susceptible to weakening, and typically manifests itself in reduced axial load, reduced drop impact resistance and reduced buckle performance. To allow lightweighting without experiencing such adverse strength characteristics, it has been found that the structure of the base profile of the container may be modified.

Figure 2:
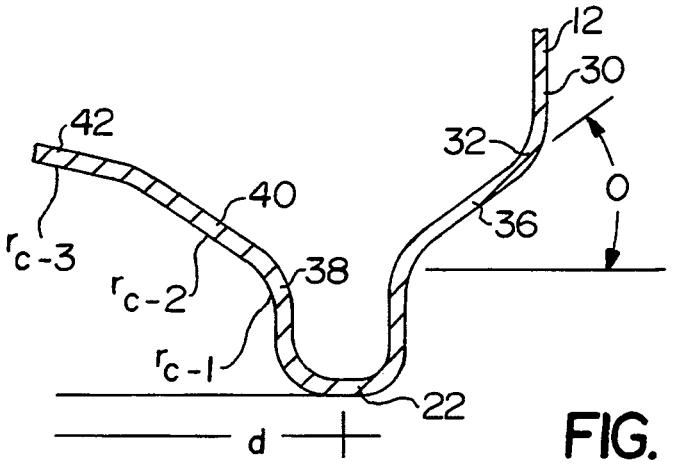
FIG. 2 is a cross-sectional view of a base portion of a container of the present invention prior to a preferred reforming operation.

There are various attempts at modification of the base portion of a container in the prior art. The present invention provides an improved unique base profile and a method of accomplishing such base profile. In particular, the present invention provides a structure for the bottom dome 18. The bottom dome 18, as best illustrated in FIG. 2, has three progressively increasing radii of curvature in the direction of the center of the dome 18. The first radius of curvature $r_{c-1}$ is provided along a portion 38 of the dome 18 above the inner wall 20 and is preferably within the range of from about 0.045 to about 0.070 inch. The second radius of curvature $r_{c-2}$ is provided along a second portion 40 of the dome and is preferably within the range of from about 0.500 to about 0.700 inch. The third radius of curvature $r_{c-3}$ is provided along a third central portion 42 of the dome and is preferably within the range of from about 1.800 to 2.400 inch. Preferable dimensions for the progressively increasing radii of curvature of the first, second and third portions are 0.050, 0.600 and 2.100 inch, respectively, for a drawn container having a base diameter d less than about 2.080 inch which is typical for a current twelve (12) ounce beer or beverage container. It will be understood by those skilled in the art that if the base diameter d changes, the preferred values for the increasing radii of curvature would also change proportionally, whether increased or decreased.

By providing the three progressively increasing radii of curvature, sometimes called three blended meridional radii, the bottom dome 18 is strengthened to resist unwanted dome reversal on drop impact. Also, the three progressively increasing radii of curvature minimizes dome depth, i.e., the extent to which the center of the dome extends into the interior of the container. In a preferred embodiment, the dome depth is 0.395 inch, and in its broader, preferable aspects dome depth is held within 0.410 inch.

The present invention is also particularly addressed to the structure of the outside wall 28 of the bottom profile. The outside wall 28 extends from a lower portion 30 of the cylindrical sidewall 12 through a convex lower body portion 32. This convex portion is radiused, preferably on the order of a 0.150 inch radius of curvature. The convex lower body portion 32 is integrally connected to a first frustoconical portion 36. The cross section of the first frustoconical portion 36 is disposed at an angle $\theta$ of at least 30° with respect to the plane 26 of the base of the container 10, hereinafter sometimes called the lower body angle $\theta$. In a preferred embodiment the lower body angle is from 30° to 60°, more preferably from 35° to 45°, and a lower body angle of 40° has been found particularly preferable.

The first frustoconical portion 36 is disposed between the convex lower body radius 32 and a concave profile radius 34. The profile radius 34 is disposed above the nose portion 22, and, in a preferred embodiment, is disposed at a radius of curvature of about 0.112 inch. An important feature of this invention is the provision of the frustoconical portion 36 between the lower body radius 32 and the profile radius 34 at a lower body angle greater than 30°. Such a structure assures that axial load strength and axial impact resistance are enhanced.

The base portion also has an outside wall portion between the concave profile radius 34 and the concave nose radius 22, called a second frustoconical wall portion. This second frustoconical portion is disposed at an angle of from about 60° to about 90° with respect to the plane of the base of the container 10.

In a preferred embodiment the base profile described above and illustrated in FIG. 2 is reformed. The reforming operation tightens the radius of curvature of the nose portion 22 of the base portion 14 and forms a reformed structure or profile such as that shown in FIG. 3.

Figure 5:
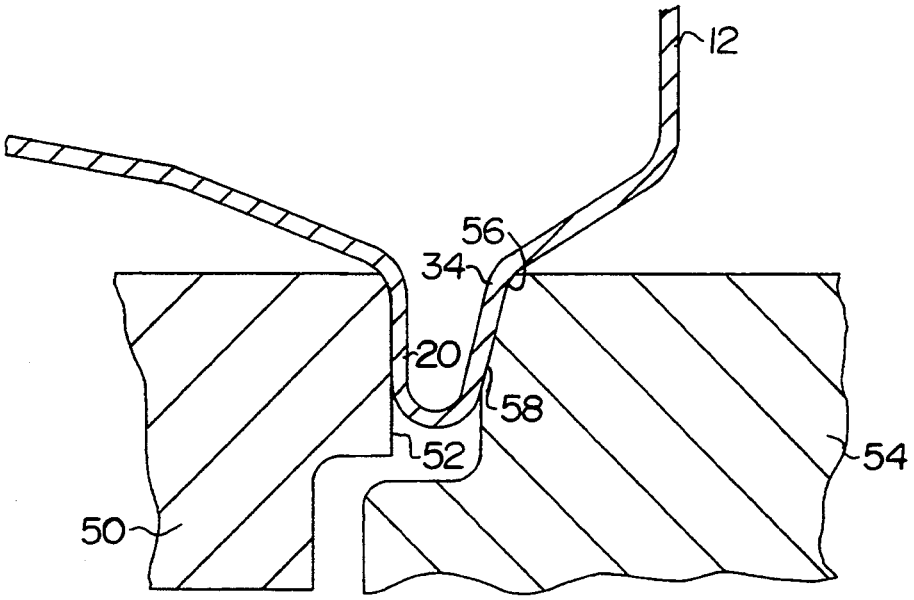
FIG. 5 is a cross-sectional view of exemplary tools which may be utilized to reform the base profile of a container of the present invention.

Such a base profile reforming operation typically involves placing the neck 16 of the container in a chuck. As shown in FIG. 5, a tool 50 is brought into contact with the inner wall 20 of the base portion 14. The inner tool 50 has a substantially vertical outside wall 52 which mates with the inner wall 20 and thereby holds the substantially vertical disposition and the diameter of the inner wall 20 during reforming. It will be appreciated that the height of the container measured from the top of the neck to the bottom of the nose portion 22 may be changed slightly during the reforming operation, such as on the order of about one time the thickness of the starting metal.

While so holding the inner wall 20 with tool 50, and rotating the tool 50 and the container mounted thereon, the outside wall 28 of the base portion 14 is reshaped such as by bringing a roll forming tool 54 into contact with the outside surface of the outside wall 28. It will be understood that the roll forming tool 54 alternatively may be rotated about a stationary container or that progressive necking dies may be employed to tighten the radius of curvature of the nose portion 22. In a preferred embodiment, a rounded corner portion 56 of the rolling tool 54 tightens the radius of curvature of the concave profile radius 34, while an inside surface 58 of the rolling tool is brought against the outside of the nose portion 22 to tighten its radius of curvature. This operation may involve rotating the container 10 or moving the roll forming tool 54 about the circumferential periphery of the nose portion 22 a number of times, such as five times, to progressively reform the base profile.

In accordance with the method of this invention, it is important that the lower body angle $\theta$ be maintained at least at 30° even after a reforming operation. It will be appreciated by those skilled in the art that the portion of the base between the convex lower body radius 32 and the concave profile radius 34 may deviate from a true frustoconical structure as a result of a reforming operation. Still, the lower body angle $\theta$ is calculatable such as from a computer aided design program plotting a series of points between the lower body radius 32 and the profile radius 34 and calculating the lower body angle $\theta$.

Figure 4:
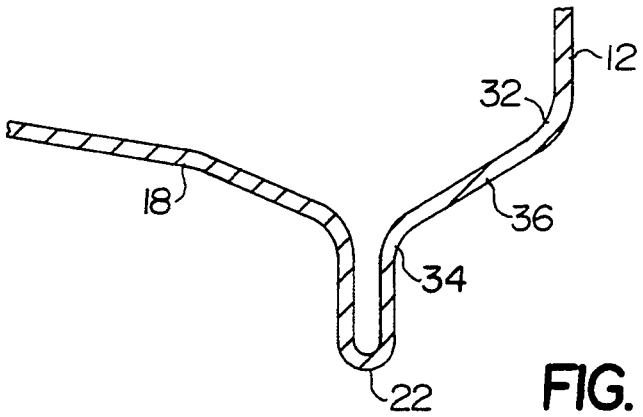
FIG. 4 is a cross-sectional view of an alternative structure of a base portion of a container of the present invention.

The reforming operation has been found appropriate because a typical bodymaker is unable to tighten the radius of curvature of the nose portion 22 of a container 10 in the forming equipment. Although the progressively increasing radii of curvature of this invention may be provided in the dome station of a bodymaker, and the initial first frustoconical section 36 at a 30° or more lower body angle may be provided in a bodymaker, an auxiliary reforming operation may be necessary. The auxiliary reforming operation typically reduces the radius of curvature of the nose portion 22, sometimes called the stand radius, below that which could be achieved in the bodymaker. A stand radius as tight as 0° may be approached by such reforming operation, such as illustrated in FIG. 4.

The initial first frustoconical section 36 is maintained to retain a lower body angle of at least 30° after a reforming operation. In reforming, the lower body angle $\theta$ may tend to decrease. In accordance with this invention, the lower body angle $\theta$ must be retained at 30° or more after reforming. The structure of the first frustoconical section 36, whether reformed or not, strengthens the can bottom particularly in the axial direction. In a preferred embodiment the lower body angle is provided at 40°, which is much steeper than 13°–20° lower body angles found in some container base profiles of the prior art.

Figure 3:
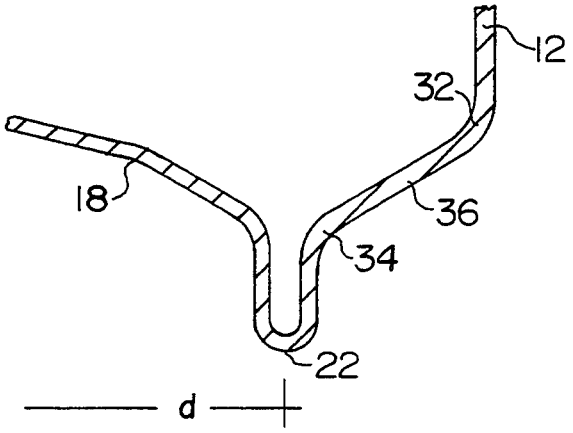
FIG. 3 is a cross-sectional view of a base portion of a container of the present invention after a preferred reforming operation.

In reforming the base portion 14 of a container of this invention, such as from the profile illustrated in FIG. 2, to the profile illustrated in FIG. 3, it will be appreciated that the base diameter d may decrease. This decrease is a direct result of the tightening of the radius of curvature of the nose portion 22. In a preferred reforming operation the nose portion 22 is tightened, but still the outside wall 28 forming the nose portion 22 will nest with and stack on cans having a 206 (2 and 6/16 inch) diameter end shell. The amount of reforming may be selectively controlled to assure stacking and nesting with the end shells or lids which may be employed. For example, a 204 (2 and 4/16 inch) diameter base with a 63° stacking angle may be reformed and be stackable with a 206 (2 and 6/16 inch) diameter lids. Generally, the base diameter of the drawn containers of this invention are less than about 2.080 inch, particularly when pertaining to conventional 12 ounce packages.

Figure 6:
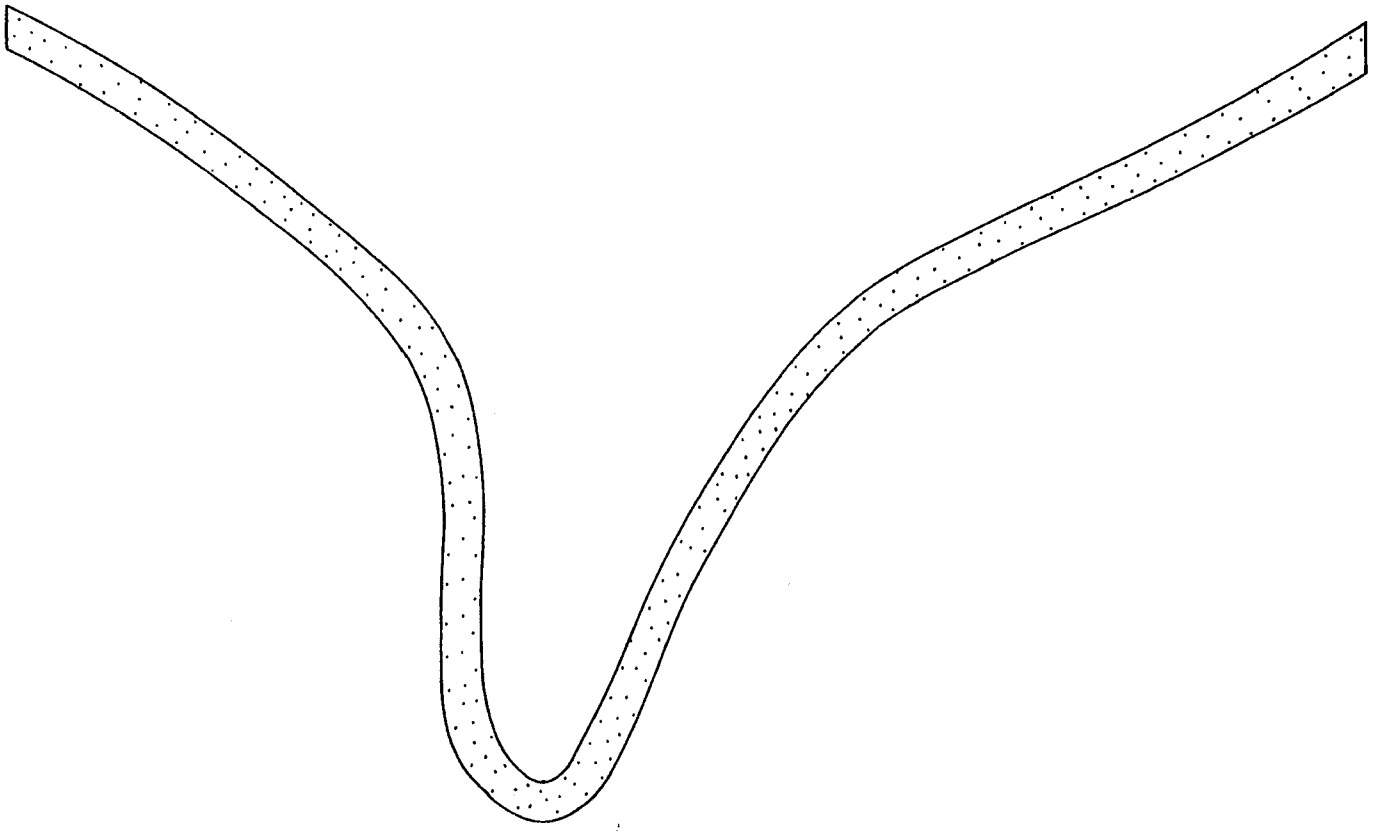
FIG. 6 is a photomicrograph of a cross section of a base portion of a container of the present invention after a preferred reforming operation.

Referring again to the drawings, FIG. 6 is a photomicrograph of a cross section of a base portion of a container of the present invention after a preferred reforming operation. The photomicrograph illustrates the uniformity in gauge that is achieved and retained in reforming the nose portion 22 to a tight radius of curvature of 0.015 inch.

To test and evaluate the base profile of the present invention, a series of aluminum containers, 3004 aluminum alloy at H19 temper, were made in three gauges: 0.0116 inch, 0.0112 inch and 0.0106 inch. The tensile and yield strengths of such material, which is typical of 3004-H19 material in the post bake condition, are as follows:

TABLE 1

| | Strength 000 psi | |
|---|---|---|
| Finish Gauge (inch) | Tensile Strength | Yield Strength |
| .0106 | 40.2 | 36.8 |
| .0112 | 40.2 | 36.6 |
| .0116 | 40.2 | 36.6 |

The bottom profile achieved in a bodymaker was that illustrated in FIG. 2. In particular, the three progressively increasing radii of curvature in the bottom dome were 0.050 inch for $r_{c-l}$, 0.600 inch for $r_{c-2}$, and 2.100 inch for $r_{c-3}$. The radius of curvature of the nose portion 22 was 0.040 inch on the inside and 0.050 inch on the outside of the nose portion 22. A frustoconical portion 36 was provided between a convex lower body radius of 0.150 inch and a concave profile radius of 0.112 inch. The lower body angle was 40°.

The preformed base, as described above, was reformed on a Model 210 Base Profile Reformer, sold by CMB Engineering, having a rated speed capability of 2800 cans per minute. The reformer tightened the stand radius to about 0.015 inch. A lower body angle $\theta$ of 30° was retained after reforming, as were the three progressively increasing radii of curvature in the bottom dome.

The following performance characteristics were measured immediately following the reforming operation:

1. dome reversal pressure,
2. axisymmetric collapse load, i.e., the load which causes bottom failure alone, and
3. can growth, i.e., the deflection of the nose of the can under increasing and decreasing pressure increments.

The results for ten samples of each were as follows:

TABLE 2

| | Dome Reversal Pressure | | |
|---|---|---|---|
| | Pressure (000 psi) | | |
| Gauge | Average | Minimum | Std. Dev. |
| .0106 | 99.6 | 99 | 0.52 |
| .0112 | 104.5 | 103 | 0.97 |
| .0116 | 110.9 | 110 | 0.88 |

TABLE 3

| | Axisymmetric Collapse Load | | |
|---|---|---|---|
| | Load (pounds) | | |
| Gauge | Average | Minimum | Std. Dev. |
| .0106 | 273.8 | 268 | 3.07 |
| .0112 | 284.1 | 280 | 2.85 |
| .0116 | 281.5 | 279 | 3.87 |

The maximum can growth observed was 0.022 inch at 90 psi which is quite acceptable.

In summary, the results demonstrated increased can strengths. Dome reversal pressure values all exceeded a 90 psi desirable maximum, axisymmetric collapse load values exceeded a 250 pound minimum, and maximum can growth was 0.022 inch at 90 psi. Additionally, the variability in results was low. It is believed that these beneficial results are attributable to the structure of the bottom profile, particularly the three increasing radii of curvature for the bottom dome, and the lower body angle $\theta$ in excess of 30° between the convex lower body radius and the concave profile radius. It is also believed that beneficial results would be attained with starting gauge on the order of 0.0096 inch, and possibly lower.

Although the preferred embodiments and best mode of this invention have been described above, it will be appreciated that numerous modifications of the details of this invention are comprehended within the spirit of this invention.

We claim:

1. In a drawn container having a generally cylindrical sidewall extending upwardly from an integral base portion forming an open neck adapted to be double seamed with a generally circular top end closure to provide a seamed pressure-holding container, said base portion having a downwardly extending, generally U-shaped circumferential nose portion defined by an inner wall, an outside wall and a concave outside nose radius therebetween, the outside surface of the nose radius defining plane of the base of the container, and an inwardly domed central portion, the improvement comprising said base portion being a reformed base portion wherein a radius of curvature of the nose portion of said base portion is tightened having:

a gauge of less than about 0.0116 inch, a substantially vertically disposed inner wall of the nose portion, the outside wall of the nose portion extending from a lower portion of the cylindrical sidewall through a convex lower body radius to a concave profile radius disposed above the nose portion, with a first frustoconical wall portion between the convex lower body radius and the concave profile radius, said first frustoconical wall portion forming a lower body angle of at least 30° with respect to the plane of the base of the container, and a second frustoconical wall portion between the concave profile radius and the concave outside nose radius, said second frustoconical wall portion disposed at an angle of from about 60° to about 90° with respect to the plane of the base of the container, with the angle of disposition of the second frustoconical wall portion being greater than the lower body angle of the first frustoconical wall portion, and the inwardly domed central portion extending inwardly of the inner wall, having at least three progressively increasing radii of curvature in the direction of the center of the dome.

2. A container as set forth in claim 1 wherein the drawn container is made of a material selected from the group consisting of an aluminum, aluminum alloy and polymer-aluminum laminate.

3. A container as set forth in claim 1 wherein the progressively increasing radii of curvature in the direction of the center of the dome are from 0.045 to 0.070 inch at a first portion adjacent the inner wall, from 0.500 to 0.700 inch at a second portion inwardly and upwardly of the first portion, and from 1.800 to 2.400 inch at a third central portion of the dome.

4. A container as set forth in claim 1 wherein the base diameter of the can measured at the center of the radius on the nose portion is less than about 2,080 inch.

5. A container as set forth in claim 1 wherein a lower body angle of about 30° to 60° is formed between the frustoconical portion of the outside wall and the plane of the base of the container.

6. A container as set forth in claim 1 wherein a lower body angle of about 35° to 45° is formed between the frustoconical portion of the outside wall and the plane of the base of the container.

7. Container as set forth in claim 1 wherein the depth of the dome measured from the plane of the base of the container is less than about 0.410 inch.

8. A drawn container having generally cylindrical sidewalls extending upwardly from an integral reformed base portion forming an open neck double seamed with a generally circular top end closure to form a seamed pressure-holding container, said base portion having:

a gauge of from about 0.0096 to about 0.0116 inch, a downwardly extending, generally U-shaped circumferential nose portion, the outside surface of the nose portion defining a plane of the base of the container, said nose portion defined by a concave outside nose radius of curvature of less than about 0.050 inch between a substantially vertically disposed inner wall and an outside wall, said radius of curvature being tightened in reforming the base portion, the outside wall extending from a lower portion of the cylindrical sidewall through a convex lower body radius of curvature of about 0.140 to 0.160 inch to a concave profile radius of curvature of about 0.100 to 0.200 inch disposed above the nose portion, with a first frustoconical wall portion between the lower body radius and the profile radius, said first frustoconical wall portion forming a lower body angle of from 30° to 40° with respect to the plane of the base of the container, and a second frustoconical wall portion between the concave profile radius and the concave outside nose radius, said outside wall portion disposed at an angle of from about 60° to about 90° with respect to the plane of the base of the container, with the angle of disposition of the second frustoconical wall portion being greater than the lower body angle of the first frustoconical wall portion, and an inwardly directed bottom dome extending inwardly of the inner wall, having three progressively increasing radii of curvature in the direction of the center of the dome of from 0.045 to 0.070 inch at a first portion adjacent the inner wall, from 0.500 to 0.700 inch at a second inward portion, and from 1.80 to 2.40 inch at a third central portion, respectively.

9. A method of reforming an integral base portion of a drawn and ironed container having a substantially cylindrical sidewall extending upwardly from an integral base portion forming an open neck adapted to be double seamed with a top end closure to form a seamed, pressure-holding container, with the integral base portion having:

a gauge of less than about 0.0116 inch, a downwardly extending, generally U-shaped, circumferential nose portion, the outside surface defining a plane of the base of the container, said nose portion defined by a radius between a substantially vertically disposed inner wall and an outside wall, the outside wall extending from a lower portion of the cylindrical sidewall through a convex lower body radius to a concave profile radius disposed above the nose portion, with a first frustoconical wall portion between the convex lower body radius and the concave outside nose radius, said first frustoconical wall portion forming a lower body angle of at least 30° with respect to the plane of the base of the container, and an inwardly directed bottom dome extending inwardly of the inner wall, having at least three progressively increasing radii of curvature in the direction of the center of the dome, said reforming method comprising the steps of holding the substantially vertical disposition and the diameter of the inner wall defining the nose portion, while holding the inner wall, tightening the radius of curvature of the nose portion and reshaping the outside wall to form an outside wall having a convex lower body radius at the base of the container sidewall, and a concave profile radius disposed above the nose portion, retaining a lower body angle greater than 30°, assuring that a second frustoconical wall portion between the profile radius and the nose portion is disposed at an angle of from about 60° to about 90° with respect to the base of the container, with the angle of disposition of the second frustoconical wall portion being greater than the lower body angle of the first frustoconical wall portion, and retaining an inwardly directed bottom dome extending inwardly of the inner wall with at least three progressively increasing radii of curvature in the direction of the center of the dome.

10. A method as set forth in claim 9 wherein the retained progressively increasing radii of curvature in the bottom dome in the direction of the center of the dome are from 0.045 to 0.070 inch at a first portion above the inner wall, from 0.500 to 0.700 inch at a second portion inwardly and upwardly of the first portion and from 1.800 to 2.400 inch at a third central portion of the dome.

11. A method as set forth in claim 9 wherein the container is reformed to a base diameter of the can measured at the center of the radius on the nose portion being less than about 2.080 inch.

12. A method as set forth in claim 9 wherein the container is reformed with a lower body angle of about 30° to 60°.

13. A method as set forth in claim 9 wherein the container is reformed with a lower body angle of about 35° to 45°.

14. A method as set forth in claim 9 wherein the container is reformed with the depth of the dome measured from the plane of the base of the container being less than about 0.410 inch.

15. A method as set forth in claim 9 wherein a starting gauge of aluminum metal from which the container is formed and reformed is from 0.0096 to 0.0116 inch.

16. A drawn container having generally cylindrical sidewalls extending upwardly from an integral base portion forming an open neck adapted to be double seamed with a top end closure to form a seamed, pressure-holding container, said base portion having:

a downwardly extending, generally U-shaped, circumferential nose portion, the outside surface defining a concave outside nose plane of the base of the container, said nose portion defined by a radius between a substantially vertically disposed inner wall and an outside wall, the outside wall extends from a lower portion of the cylindrical sidewall through a convex lower body radius to a concave profile radius disposed above the nose portion, with a first frustoconical wall portion between the convex lower body radius and the concave outside nose radius, said first frustoconical wall portion forming a lower body angle of at least 30° with respect to the plane of the base of the container, and an inwardly directed bottom dome extending inwardly of the inner wall, having at least three progressively increasing radii of curvature in the direction of the center of the dome, reformed to provide a drawn container with increased strength by the process of:

holding the substantially vertical disposition and the diameter of the inner wall defining the nose portion, while holding the inner wall, tightening the radius of curvature of the nose portion and reshaping the outside wall to form an outside wall having a convex lower body radius at the base of the container sidewall, and a concave profile radius disposed above the nose portion, retaining a lower body angle greater than 30° for the first frustoconical wall portion, assuring that a second frustoconical wall portion between the profile radius and the nose portion is disposed at an angle of from about 60° to about 90° with respect to the base of the container, with the angle of disposition of the second frustoconical wall portion being greater than the lower body angle of the first frustoconical wall portion, and retaining an inwardly directed bottom dome extending inwardly of the inner wall with at least three progressively increasing radii of curvature in the direction of the center of the dome.

* * * * *